US007204526B2

(12) United States Patent
Seo

(10) Patent No.: US 7,204,526 B2
(45) Date of Patent: Apr. 17, 2007

(54) HOOD LATCH ASSEMBLY FOR A VEHICLE

(75) Inventor: Chang Su Seo, Osan-si (KR)

(73) Assignee: Hyundai Motor Company, Seocho-Ku, Seoul (KR)

( * ) Notice: Subject to any disclaimer, the term of this patent is extended or adjusted under 35 U.S.C. 154(b) by 98 days.

(21) Appl. No.: 11/024,871

(22) Filed: Dec. 28, 2004

(65) Prior Publication Data

US 2006/0006660 A1 Jan. 12, 2006

(30) Foreign Application Priority Data

Jun. 22, 2004 (KR) ..... 10-2004-0046610

(51) Int. Cl.
*E05C 7/00* (2006.01)

(52) U.S. Cl. ..... 292/24; 292/DIG. 14; 292/25

(58) Field of Classification Search ..... 292/24, 292/25, DIG. 14, 26, 56, 240
See application file for complete search history.

(56) References Cited

U.S. PATENT DOCUMENTS 3,397,906 A * 8/1968 Beckman et al. ..... 292/29
3,905,624 A * 9/1975 Fujita ..... 292/11
4,991,884 A * 2/1991 Cairns ..... 292/28
5,738,393 A * 4/1998 Chao ..... 292/216
5,765,884 A * 6/1998 Armbruster ..... 292/216
5,803,515 A * 9/1998 Arabia et al. ..... 292/216
5,971,448 A * 10/1999 Hayakawa et al. ..... 292/216
6,106,033 A * 8/2000 Ruckert ..... 292/216
6,485,071 B2 * 11/2002 Schwaiger ..... 292/216
6,543,822 B1 * 4/2003 King et al. ..... 292/214
6,568,720 B1 * 5/2003 Szablewski ..... 292/201
6,581,988 B1 * 6/2003 Mihail ..... 292/216
6,886,869 B2 * 5/2005 Martinez et al. ..... 292/216

* cited by examiner

*Primary Examiner*—Brian E. Glessner
*Assistant Examiner*—Mark Williams
(74) *Attorney, Agent, or Firm*—Morgan Lewis & Bockius LLP

(57) ABSTRACT

A hood latch assembly includes a safety lever that is operative in conjunction with the movement of a latch plate so as to ensure a sufficient space between the safety lever and a hood. Namely, the safety lever is arranged in a folded condition when the latch plate constrains a striker of a hood, i.e. the hood is securely closed by the latch assembly. The safety lever is tilted up into an upright position only when the striker becomes freed from the constraint of the latch plate. Such an arrangement of the hood latch assembly provides a sufficient space between the safety lever and the hood to reduce any impact on a human body when a pedestrian collides with a hood of the vehicle.

4 Claims, 6 Drawing Sheets

HOOD LATCH ASSEMBLY FOR A VEHICLE

CROSS REFERENCE TO RELATED APPLICATION

This application is based on, and claims priority to, Korean Patent Application No. 2004-0046610, filed on Jun. 22, 2004, the disclosure of which is hereby incorporated by reference.

TECHNICAL FIELD

The present invention generally relates to a hood latch assembly for a vehicle. More particularly the hood latch assembly is provided with a safety lever that is operative in conjunction with the movement of a latch plate so as to ensure a sufficient space between the safety lever and a hood.

BACKGROUND

Generally, a vehicle is provided with a hood covering an engine compartment and a latch assembly for opening or closing the hood.

However, conventional hood latch assemblies have a number of disadvantages. For example, they often include a safety latch that requires manual release at the front of the vehicle allowing the hood to be opened. However, it is difficult to provide sufficient space between the safety lever and the hood. This is an important factor when designing to reduce an impact on a human body as a pedestrian is collided with a hood part of the vehicle, as the safety lever is always disposed in an upright position.

Moreover, conventional hood latch assemblies are a disadvantage in that their size is limited by spatial constraints and the shape of the safety lever. The size of the safety lever is generally preferred to be as large as possible for easy manipulation.

SUMMARY OF THE INVENTION

It is an object of the present invention to provide a hood latch assembly having a safety lever that is operative in conjunction with the movement of a latch plate so as to ensure a sufficient space between the safety lever and a hood. Namely, the safety lever is arranged in a folded condition when the latch plate constrains a striker of a hood, i.e. the hood is securely closed by the latch assembly. The safety lever is tilted up into an upright position only when the striker becomes freed from the constraint of the latch plate. Such an arrangement of the hood latch assembly can provide a sufficient space between the safety lever and the hood to reduce an impact on a human body as a pedestrian is collided with a hood part of the vehicle, thereby enabling to comply with traffic regulations for safety of a pedestrian.

It is another object of the present invention to provide a hood latch assembly having an enlarged safety lever, which enables ease handling of the same.

To achieve these objects of the present invention, one embodiment of a hood latch assembly includes a base plate secured to the body of a vehicle. A latch plate is rotatably attached to the inner surface of the base plate. The latch plate is furnished with a guide pin. A safety lever consisting of a body portion and a handle portion is rotatably attached to the outer surface of the base plate. The body portion of the safety lever is provided with a guide slot, in which the guide pin of the latch plate is slideably engaged. The handle portion of the safety lever rotates in accordance with the movement of the latch plate by means of the guide pin of the latch plate.

Preferably, the handle portion of the safety lever is coupled to the body portion of the safety lever by a hinge pin, around which a coil spring is mounted while biasing the handle portion of the safety lever to pivot toward a lying position. Both ends of the coil spring are fixed to the handle portion of the safety lever and the body portion of the safety portion, respectively.

BRIEF DESCRIPTION OF THE DRAWINGS

The aforementioned aspect and other features of the present invention will be explained in the following detailed description, taken in conjunction with the accompanying drawings, wherein.

DETAILED DESCRIPTION OF PREFERRED EMBODIMENTS

Figure 1:
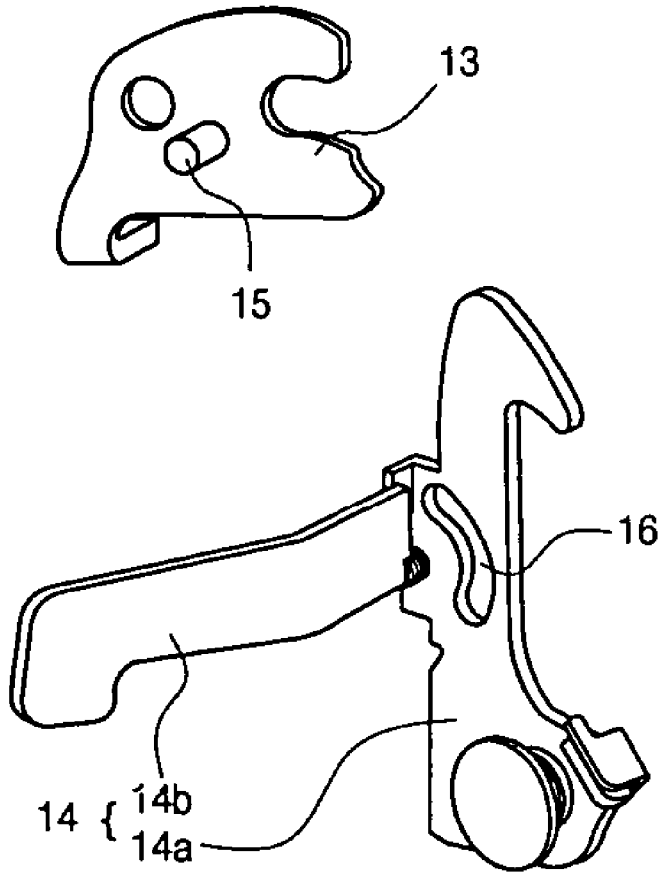
FIG. 1 is a perspective, exploded view of a safety lever and a latch plate of an embodiment of a hood latch assembly according to the present invention.
Figure 2:
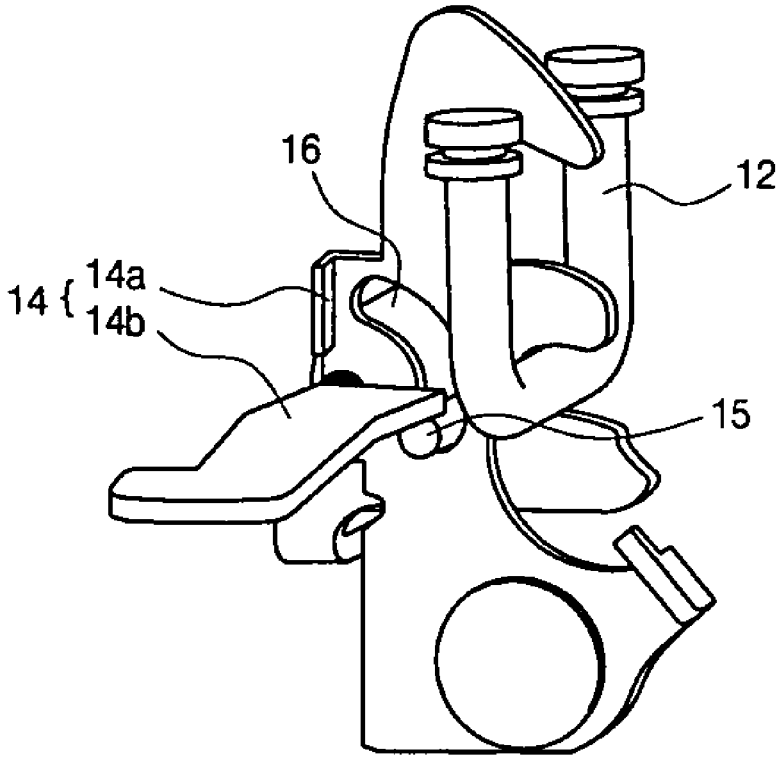
FIG. 2 is a perspective view of a safety lever and a latch plate of an embodiment of a hood latch assembly according to the present invention.
Figure 4:
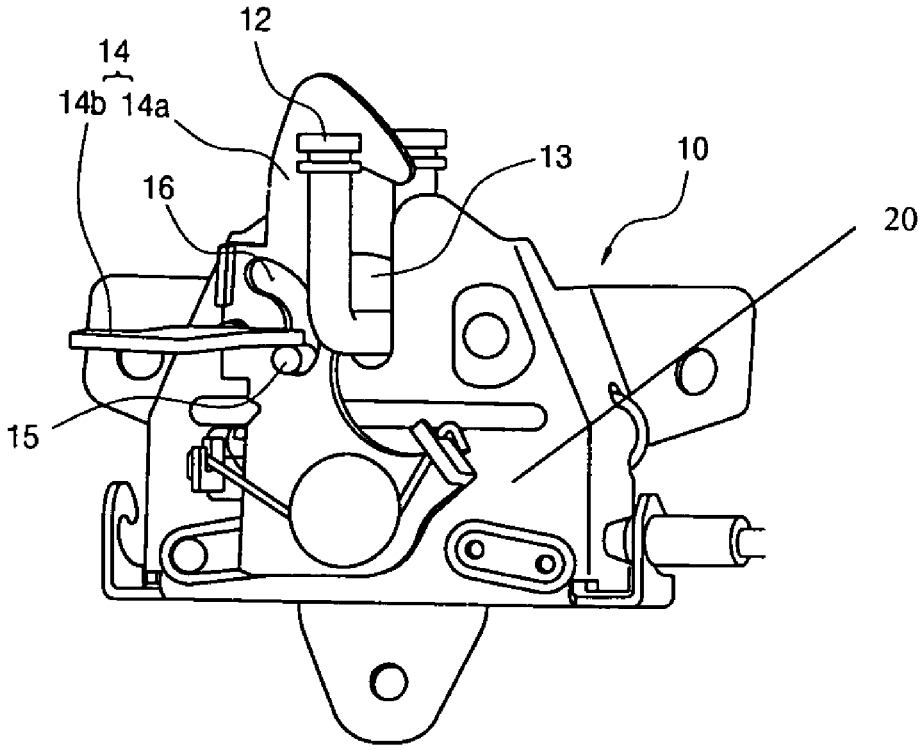
FIG. 4 is a perspective view of a closed state of an embodiment of a hood latch assembly according to the present invention.

Referring to FIGS. 1 and 2, the hood latch assembly 10 comprises a latch plate 13 rotatably attached to the inner surface of a base plate 20 (FIG. 4). The latch plate 13 latches a striker 12 of a hood by means of a notch formed at the end thereof. When an operator manipulates a knob connected to the latch assembly via a cable, the striker 12 is released from the notch of the latch plate 13 as the latch plate 13 rotates. Such opening operation is similar to that of a conventional hood latch assembly.

The latch plate 13 is furnished with a guide pin 15 at one surface thereof. The guide pin 15 is configured to be perpendicular to the surface of the latch plate 13.

Figure 3:
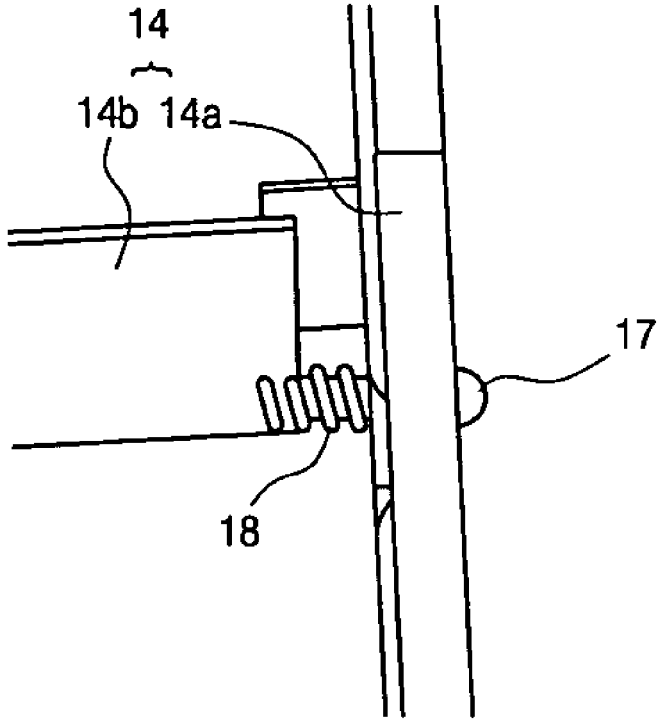
FIG. 3 is a side view showing a coupling manner between a body portion and a handle portion of a safety lever of an embodiment of a hood latch assembly according to the present invention.

As shown in FIGS. 1 and 3, a safety lever 14 operative in conjunction with the latch plate 13 consists of a body portion 14*a* and a handle portion 14*b*. The safety lever 14 is rotatably attached to the outer surface of the base plate 20. The body portion 14*a* of the safety lever 14 is provided with a guide slot 16, in which the guide pin 15 of the latch plate 13 is slidably inserted. The guide slot 16 has an arc shape so that the guide pin 15 slides therein in accordance with the rotation of the latch plate 13.

Formed at the upper end of the body portion 14*a* of the safety lever 14 is a hook adapted to temporarily latch the striker 12 that is released from the latch plate 13 by manipulation of an operator. The body portion 14*a* of the safety lever 14 is rotatably attached to the base plate 20 by means of a pin adjacent to the lower end thereof. The handle portion 14*b* extends toward the front end of a vehicle for ease operation of the latch assembly. The handle portion 14*b* is rotatably, and perpendicularly connected to the body portion 14*a* via a hinge pin 17 that is integrally formed at the proximal end of the handle portion 14*b*. Around the hinge pin 17, a coil spring 18 is mounted while biasing the handle portion 14*b* of the safety lever 14 to pivot toward a horizontal or lying position. Accordingly, in absence of an external force, the handle portion 14*b* remains in the horizontal or lying position.

Referring to FIG. 4 showing a locked state of the hood latch assembly according to the present invention, the latch plate 13 securely constrains the striker 12, wherein the handle portion 14*b* of the safety lever 14 pivots toward the lying position by the biasing force of the coil spring 18 while further pivot of the handle portion 14*b* is restrained by means of the guide pin 15.

Figure 5:
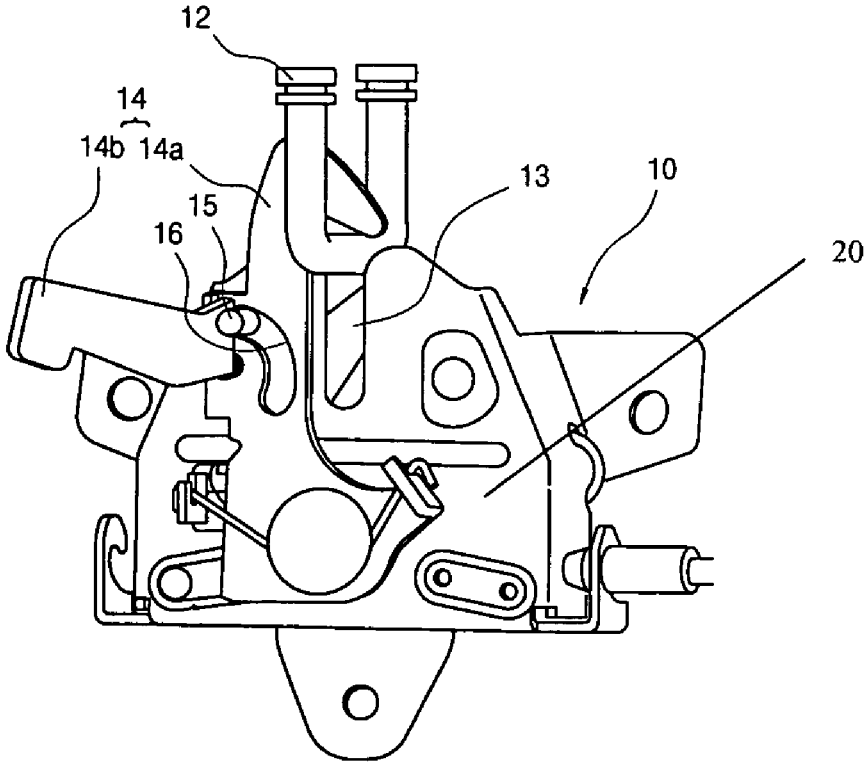
FIG. 5 is a perspective view of a released state of an embodiment of a hood latch assembly according to the present invention.

Referring to FIG. 5 showing a released state of the hood latch assembly according to the present invention, when an operator manipulates a knob connected to the latch assembly via a cable, the latch plate 13 is unlocked and rotates by a spring means installed thereto while releasing the striker 12 from a notch thereof. Along the rotation of the latch plate 13, the guide pin 15 also slides within the guide slot 16 while tilting up the handle portion 14*b* of the safety lever 14 into an upright position against the biasing force of the coil spring 18. It should be appreciated that the elastic force of the spring means installed to the latch plate 13 is larger than the biasing force of the coil spring 18.

With such an arrangement, when the handle portion 14*b* of the safety lever 14 is folded up into the upright position, the operator may open a hood 11 of a vehicle by pushing the handle portion 14*b* toward a left direction.

Figure 6:
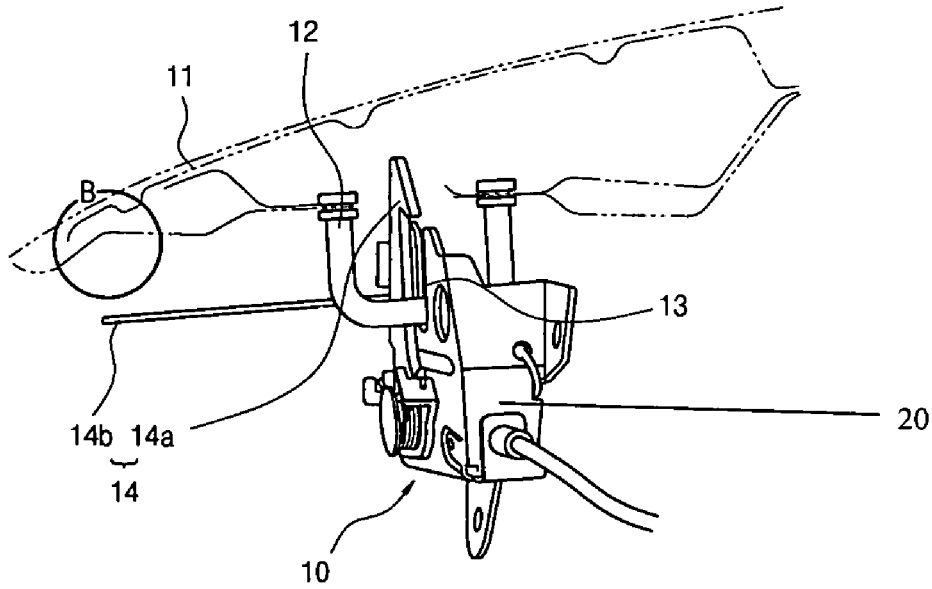
FIG. 6 is a perspective view of the hood latch assembly, taken from the side of a vehicle so as to clearly illustrate an arrangement of a safety lever of an embodiment of a hood latch assembly according to the present invention.

As shown in FIG. 6, according to the present invention, a sufficient space "B" between the hood and the handle portion of the safety lever, with which it is possible to significantly reduce an impact on a human body as a pedestrian is collided with the hood part of a vehicle, can be obtained. Furthermore, the size of the handle portion of the safety lever may be enlarged because the handle portion of the safety lever is in horizontal or laying position when the hood is closed.

As the foregoing description, the hood latch assembly according to the present invention, which is provided with the safety lever operative in conjunction with the movement of the latch plate, is advantageous in that a sufficient space can be obtained between the safety lever and the hood to reduce an impact on a human body as a pedestrian is collided with a hood part of the vehicle. Moreover, the hood latch assembly according to the present invention is advantageous in that an enlarged handle portion of the safety lever can be provided enabling ease of operation of the safety lever because the handle portion of the safety lever is in a horizontal or laying position when the hood is closed.

Even though the present invention is described in detail with reference to the foregoing embodiments, it is not intended to limit the scope of the present invention thereto. It is evident from the foregoing that many variations and modifications may be made by a person having an ordinary skill in the present field without departing from the essential concept of the present invention.

What is claimed is:

1. A hood latch assembly comprising:

a base plate configured to be secured to a body of a vehicle and comprising an inner and an outer surface;

a latch plate rotatably attached to the inner surface of the base plate;

a guide pin fixed to the latch plate;

a safety lever rotatably attached to the outer surface of the base plate, wherein the safety lever comprises a body portion and a handle portion; and a guide slot formed in the body portion of the safety lever, wherein the guide pin fixed to the latch plate is slideably engaged with the guide slot, wherein the handle portion of the safety lever rotates in accordance with the movement of the latch plate by means of the guide pin of the latch plate;

wherein the handle portion of the safety lever is rotatably coupled to the body portion of the safety lever via a hinge pin, around which a coil spring is mounted while biasing the handle portion of the safety lever to pivot toward a lying position, wherein each end of the coil spring is fixed to the handle portion of the safety lever and the body portion of the safety lever, respectively.

2. The hood latch assembly according to claim 1, wherein the hinge pin is integrally formed at the proximal end of the handle portion.

3. A hood latch assembly comprising:

a base plate configured to be secured to a body of a vehicle;

a latch plate rotatably attached to the base plate;

a guide pin fixed to the latch plate;

a safety lever rotatably attached to the base plate, wherein the safety lever comprises a body portion and a handle portion; and a guide slot formed in the body portion of the safety lever, wherein the guide pin of the latch plate is slideably engaged with the guide slot, wherein the handle portion of the safety lever rotates in accordance with the movement of the latch plate by means of the guide pin of the latch plate;

wherein the handle portion of the safety lever is rotatably coupled to the body portion of the safety lever via a hinge pin, around which a coil spring is mounted while biasing the handle portion of the safety lever to pivot toward a lying position, wherein each end of the coil spring is fixed to the handle portion of the safety lever and the body portion of the safety lever, respectively.

4. The hood latch assembly according to claim 3, wherein the hinge pin is integrally formed at the proximal end of the handle portion.

* * * * *